US007842868B2

(12) United States Patent
Else

(10) Patent No.: US 7,842,868 B2
(45) Date of Patent: Nov. 30, 2010

(54) STRINGED INSTRUMENT NECK STRUCTURE ADJUSTING ARRANGEMENT

(75) Inventor: Robert Else, Tewkesbury (GB)

(73) Assignee: Avant-Garde Guitars Limited, Tewkesbury, Gloucestershire (GB)

( * ) Notice: Subject to any disclaimer, the term of this patent is extended or adjusted under 35 U.S.C. 154(b) by 174 days.

(21) Appl. No.: 11/940,416

(22) Filed: Nov. 15, 2007

(65) Prior Publication Data

US 2008/0121086 A1 May 29, 2008

Related U.S. Application Data

(60) Provisional application No. 60/867,111, filed on Nov. 23, 2006.

(51) Int. Cl.
*G10D 3/00* (2006.01)

(52) U.S. Cl. ..... 84/293; 84/264; 84/269

(58) Field of Classification Search ..... 84/293
See application file for complete search history.

(56) References Cited

U.S. PATENT DOCUMENTS

| | | | | |
|---|---|---|---|---|
| 2,460,943 A | | 2/1949 | Nelson | |
| 2,597,154 A | | 5/1952 | Maccaferri | |
| 2,649,828 A | * | 8/1953 | Maccaferri | 84/314 R |
| 2,495,988 A | | 6/1957 | Macaferri | |
| 3,244,054 A | | 4/1966 | Berglund | |
| 3,251,257 A | | 5/1966 | Bunker | |
| 3,417,646 A | | 12/1968 | Cookerly et al. | |
| 3,538,807 A | * | 11/1970 | Francis | 84/267 |
| 3,805,663 A | | 4/1974 | Okugawa | |
| 3,943,816 A | | 3/1976 | Goursau | |
| 4,084,476 A | | 4/1978 | Rickard | |
| 4,145,948 A | | 3/1979 | Turner | |
| 4,172,405 A | | 10/1979 | Kaman, II | |
| 4,201,108 A | | 5/1980 | Bunker | |
| 4,213,370 A | | 7/1980 | Jones | |
| 4,304,277 A | | 12/1981 | Petillo | |
| 4,557,174 A | * | 12/1985 | Gressett, Jr. | 84/293 |

(Continued)

FOREIGN PATENT DOCUMENTS

DE 20 2005 005 270 7/2005

(Continued)

OTHER PUBLICATIONS

Kuronen, Darcy et al., "Dangerous Curves: The Art of the Guitar," 2000, pp. 119-120, 157-158, and unknown page number, MFA Publications.

*Primary Examiner*—Elvin G Enad
*Assistant Examiner*—Christopher Uhlir
(74) *Attorney, Agent, or Firm*—King & Schickli, PLLC

(57) ABSTRACT

A stringed instrument (10A) neck structure adjusting arrangement includes a cantilever member (39). One end of the cantilever member is configured to be connected, in use, to a body and/or neck structure of the stringed instrument. The cantilever member is configured to be moveable relative to a free end of the neck structure of the stringed instrument. The arrangement also includes an adjustment device (30) located at or adjacent a free end of the cantilever member. The adjustment device is configured to adjust a position of the cantilever member (39) relative to the neck structure, thereby adjusting curvature of the neck structure. The adjustment is in a plane substantially perpendicular to a main axis of the neck structure.

25 Claims, 10 Drawing Sheets

U.S. PATENT DOCUMENTS

| | | | | |
|---|---|---|---|---|
| 4,681,009 | A | 7/1987 | Mouradian | |
| 5,018,423 | A | 5/1991 | Bunker et al. | |
| 5,180,876 | A * | 1/1993 | Thorward | 84/293 |
| 5,249,498 | A | 10/1993 | Wilfer et al. | |
| 5,421,233 | A | 6/1995 | Bunker | |
| 5,895,872 | A | 4/1999 | Chase | |
| 5,911,168 | A | 6/1999 | Enserink | |
| 5,965,830 | A | 10/1999 | Carlson | |
| 6,051,765 | A | 4/2000 | Regenberg et al. | |
| 6,259,008 | B1 | 7/2001 | Eddinger et al. | |
| 6,399,862 | B1 * | 6/2002 | Wilfer | 84/293 |
| 7,141,730 | B1 | 11/2006 | Wu | |
| 2003/0000365 | A1 | 1/2003 | Hirayama et al. | |
| 2003/0140765 | A1 | 7/2003 | Herman | |
| 2004/0129126 | A1 | 7/2004 | Goto | |

FOREIGN PATENT DOCUMENTS

| | | |
|---|---|---|
| EP | 0 661 523 | 7/1995 |
| GB | 2 045 503 | 10/1980 |
| KR | 8201695 | 9/1982 |
| KR | 0137074 B | 6/1998 |
| KR | 20030078499 | 10/2003 |

* cited by examiner

STRINGED INSTRUMENT NECK STRUCTURE ADJUSTING ARRANGEMENT

The present application claims priority from U.S. Provisional patent application Ser. No. 60/867,111 filed on Nov. 23, 2006.

FIELD OF THE INVENTION

The present invention relates to adjusting a neck structure of a stringed musical instrument.

BACKGROUND TO THE INVENTION

There have been a number of proposals for the construction of stringed musical instruments, such as guitars, to either allow them to be manufactured more efficiently or to be more stable in terms of their susceptibility to changes in temperature and humidity. Examples of such existing manufacturing techniques include the use of plastic polymers (which can be fibre reinforced) for the construction of both the necks and bodies, and various methods of reinforcing the necks of more traditional wood based designs to control or limit their curvature or bending under the effect of the tension exerted by the strings. The latter reinforcements include steel rods (commonly termed "truss rods") that include an adjustment mechanism to allow control over the curvature of the neck (and hence the curvature of the fingerboard), plus steel or carbon fibre strips, aluminium extrusions or castings in aluminium or magnesium that simply reinforce the neck without providing a means of adjustment.

Normally, if a truss rod type of construction is used then a steel rod is placed along the axis of the neck of the instrument in such a manner that it is disposed to the rear of the neck (the opposite side from the finger board) in the cross section area of the neck (behind the neutral axis) that experiences tensile forces, (or reduced compressive forces compared to the front part of the neck), when the neck is loaded by the tension from the strings. Typically, the rod is fixed at one end of the neck (usually the body end) and a threaded adjustment mechanism is provided at the other end (along the axis of the rod) that allows the rod to be tensioned by varying amounts. The rod may also be curved in shape and act upon the neck material as it is tensioned to control the neck curvature. The variations in tension generated in the truss rod allow the curvature of the neck (and hence the fingerboard of the instrument) to vary, providing more or less clearance for the elliptical shape of the vibrating strings when the latter are plucked or bowed by the musician.

FIG. 1*a* is a simplified side elevation view of first type of existing instrument where the neck 1 is effectively a non-adjustable "strong" beam or strut incorporating a fingerboard 6 against which the strings 2 are pressed when played. The beam 1 resists the tension in the strings 2, which are attached to body 4 of the instrument at position 3 and extend to the end of the neck at position 5. The effects of the string tension (which is in effect an offset loading producing both compressive and bending forces) are shown in FIG. 1*b*, which shows their load/tension produces a neck deflection 8, which results in the fingerboard being curved as shown at position 7.

FIG. 2*a* shows a similar simplified side elevation view of another type of existing instrument that has strings 2 disposed between anchorage positions 3 and 5 and a fingerboard surface 6 and body 4. A beam 9 is supplemented by a truss rod 10 that is anchored to one end of the neck or body 4 at position 11, and includes a threaded part 13 engaging with a threaded nut 12. FIG. 2*b* shows the effects of the tension of the strings 2 producing a displacement 8 of the neck, which results in a curvature of the fingerboard as shown in position 7. FIG. 2*c* shows how changes to the threaded adjustment mechanism 12 and 13 can alter the deflection 14 of the neck and hence the curvature of the fingerboard. In this Figure the effect of tightening the nut 12 can be seen as a reduction in the neck curvature and hence a reduction in the fingerboard curvature). Note that the adjustment mechanism is substantially in line with the axis of the neck of the instrument. Whilst this type of arrangement is practical where the neck of the instrument is made from wood it is much more difficult to incorporate in a neck formed from plastic mouldings. Also, such truss rods do not take any of the compressive loads imparted by the string tension; they actually increase the compressive loads in the neck and this can affect the resonance of the neck or the instrument as a whole.

SUMMARY OF THE INVENTION

Embodiments of the present invention provide means for constructing an instrument that allows cost-effective manufacture; reduced susceptibility to temperature/humidity changes, and a distinctive tone and sound from the instrument. They can also improve in the tone and sustain of the vibrating strings when played (by means of a very stiff and strong construction) and offer more freedom in the styling of the instrument by the manufacturer. Embodiments also allow adjustment of the curvature of the fingerboard of the instrument to compensate for varying gauges of strings and tensions, allowing a player to set up the instrument to suit their playing style.

According to a first aspect of the present invention there is provided a stringed instrument neck structure adjusting arrangement including:

a cantilever member, one end of which is configured to be connected, in use, to a body and/or neck portion of the stringed instrument, the cantilever member configured to be moveable relative to a free end of the neck structure of the stringed instrument, and an adjustment device located at or adjacent a free end of the cantilever member, the adjustment device configured to adjust a relative position of the cantilever member and the neck structure in a plane substantially perpendicular to a main axis of the neck structure, thereby adjusting curvature of the neck structure.

The arrangement may further include an elongate member configured to extend at least partially along a length of the neck structure, one end of the elongate member being connected to body and/or the neck structure, another end of the elongate member being adjustably connected to or adjacent the free end of the cantilever member. The cantilever member may be elongate and extend substantially parallel to at least part of the elongate member. One end of the cantilever member may be configured to be fixed to a portion of the elongate member that is located within the body of the stringed instrument, or to a portion of the neck structure at or adjacent the body of the stringed instrument. The cantilever member may be rigidly connected to the neck structure and/or body of the stringed instrument and the rigid connection resists compressive and bending loads imparted by tension of strings of the instrument. A corresponding end of the elongate member may also be fixed to a portion of the stringed instrument that is on, in or adjacent the body, with the adjusting device adjusting relative position of opposite ends of the elongate and cantilever members. The elongate and cantilever members may be connected to the neck structure and/or the body of the stringed instrument by means of a separate assembly that is fixed within (or to) the neck structure and/or the body. The assembly can include extending portions configured to be linked to portions of the instrument, e.g. inner surfaces of its body. The moveable part of the cantilever member will not normally be directly connected to an elongate surface of the neck structure.

The elongate member may comprise first and second elongate bars, each said elongate bar being located either side of the cantilever member. The first and/or second elongate bars may be at least partially formed of metal. A low-friction surface treatment or material may be present on/between at least parts of the bars and corresponding sides of the cantilever member. A further device for preventing or damping any rattles between the cantilever and elongate member (such as felts pads) may be disposed between the adjacent surfaces of the cantilever and elongate members. The further device may also to align the cantilever member between the elongate members. This means for preventing rattles may also align the cantilever member between the two elongate bars, or some other device may be employed for this function—typically one positioned close to the area where the adjustment device is located. The first and second elongate bars may be at least partially of generally L or U-shaped cross section. The first and second elongate bars may be mirror images of each other, or they may be asymmetric. A stem portion of each of the first and second L or U-shaped elongate bars may be located parallel to a respective side surface of the cantilever member. A portion of the L-shaped member transverse to its stem portion may be configured to be (directly or indirectly) connected to (inside) a surface, e.g. a surface having a fingerboard portion of the neck structure.

The adjustment device can include an elongate adjustment member extending generally perpendicularly with respect to the cantilever member, at least part of the cantilever member being moveable along or with the elongate adjustment member, the adjustment device further including a formation for arresting such relative movement of the elongate adjustment member and the cantilever member. The adjusting device may include a threaded member, where, in use, rotation of the threaded member results in movement of the elongate member relative to the cantilever member. The threaded member may comprise a nut, a screw or a stud. The adjusting device may further include a saddle piece in contact with the adjustment device, the saddle facilitating simultaneous movement of the first and second bars relatively to the cantilever member.

Some embodiments can include two or more adjusting devices, e.g. a pair of said adjusting devices disposed either side of a central axis of the neck structure. The adjustment device locking arrangement may comprise a clamping member whose position relative to the elongate surface of the neck structure can be fixed, in use, the clamping member contacting a portion of the adjusting device, thereby limiting/preventing its movement.

According to a further aspect of the present invention there is provided a neck structure for a stringed instrument including an adjusting arrangement substantially as described herein. According to yet another aspect of the present invention there is provided a stringed instrument including a neck structure adjusting arrangement substantially as described herein.

The stringed instrument may be formed of at least two members forming a shell in which the neck structure adjusting arrangement is fitted. The term "shell" can be considered to mean that the parts have space within them to accept an internal structural assembly. The members may be formed of plastic materials and may be moulded. At least some spaces/voids in the shell/stringed instrument may be filled with a filling material such as foam. A counter-balance mass may be located within a body portion of the instrument. The shell may include a formation (e.g. an aperture) to allow access to the adjusting device. The formation may be located on a portion of the neck structure remote from the body (this will usually be the case with "headless" guitars), or the formation may be located at or adjacent a head portion of the instrument, e.g, on a surface of the head portion over which strings of the instrument extend. The instrument may include a plastic fingerboard having integrally-moulded position markers, the fingerboard also being formed of a plastic material. The position markers can be formed so as to be distinct from a main surface of the fingerboard, e.g. by being formed of plastic of a contrasting colour or texture. (It is also possible to 'mould in' discrete position markers by placing for instance markers made from shell, metal, or other materials against the fingerboard section in the mould and then moulding the main plastic material around them).

According to a further aspect of the present invention there is provided a method of manufacturing a stringed instrument substantially as described herein.

According to yet another aspect of the present invention there is provided a stringed musical instrument at least partially formed of a plastic material, the instrument including integrally-moulded plastic portions.

The instrument may include a fingerboard and the integrally-moulded portions may include position markers. Typically, the position makers will be formed so as to be distinct from a main surface of the fingerboard, e.g. by being formed of plastic of a contrasting colour or texture. The position markers and/or the main surface may be formed of plastic polymer materials. Plastic resins that colour the surface of the fingerboard and the position markers may be gel coat resins that are supported by a polyester or epoxy resin matrix. The matrix may include fibres or other types of reinforcement. Other parts or surfaces of the instrument may be integrally moulded in contrasting-coloured plastic materials. Some of the coloured areas may be provided by means of paint applied to the moulded surface prior to the moulding process.

According to another aspect of the present invention there is provided a stringed instrument neck structure adjusting arrangement including:

a first member configured to be directly or indirectly connected to an elongate surface of a neck structure of a stringed instrument;

a second member configured to be connected to another portion of the stringed instrument, at least part of the second member configured to be moveable relative to the first member, and an adjustment device for adjusting a relative position of the first and second members, thereby adjusting curvature of the neck structure.

Whilst the invention has been described above, it extends to any inventive combination of the features set out above or in the following description. Although illustrative embodiments of the invention are described in detail herein with reference to the accompanying drawings, it is to be understood that the invention is not limited to those precise embodiments. As such, many modifications and variations will be apparent to practitioners skilled in this art. Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

BRIEF DESCRIPTION OF THE DRAWINGS

The invention may be performed in various ways, and, by way of example only, embodiments thereof will now be described, reference being made to the accompanying drawings, in which:

FIG. 13 is a sectional view similar to that of FIG. 12, of an alternative version of the instrument that includes a further arrangement for locking the mechanism and.

DETAILED DESCRIPTION OF THE DRAWINGS

Figure 1A:
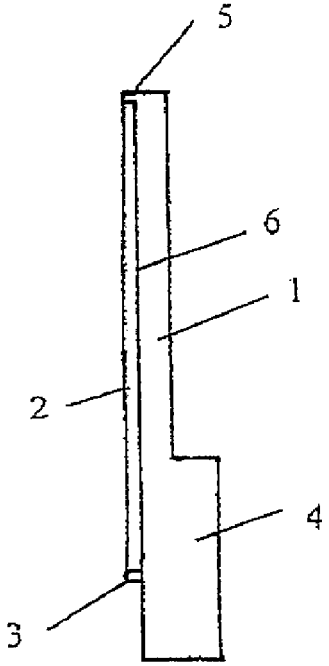
FIGS. 1*a* and 1*b* are schematic side views illustrating curvature of a neck of a first type of existing stringed instrument.
Figure 1B:
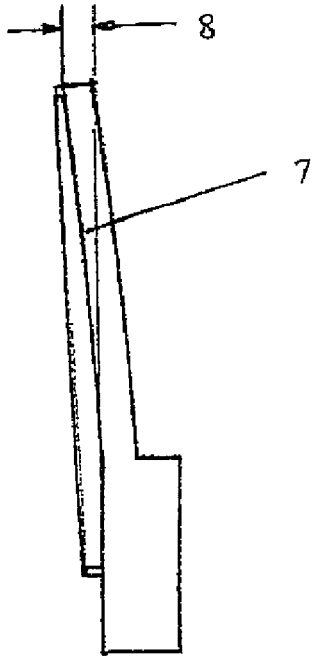
Figure 2A:
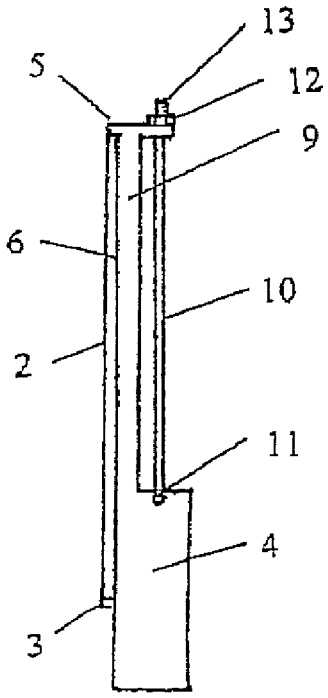
FIGS. 2*a*, 2*b* and 2*c* are schematic side views illustrating curvature of a neck of a second type of existing stringed instrument.
Figure 2B:
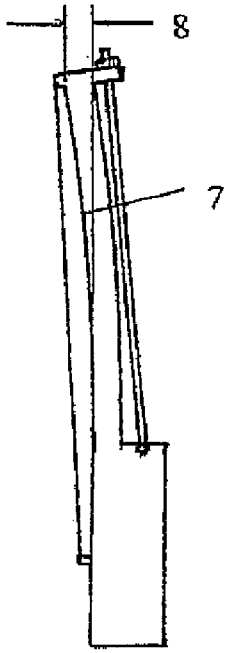
Figure 2C:
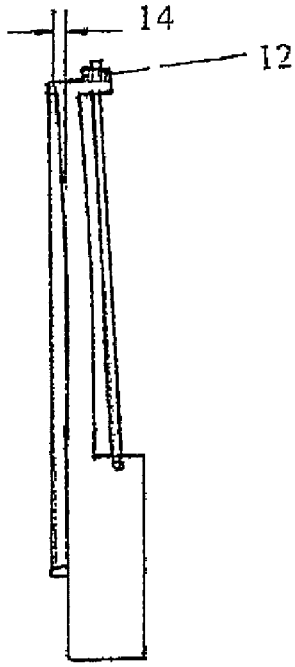
Figure 3A:
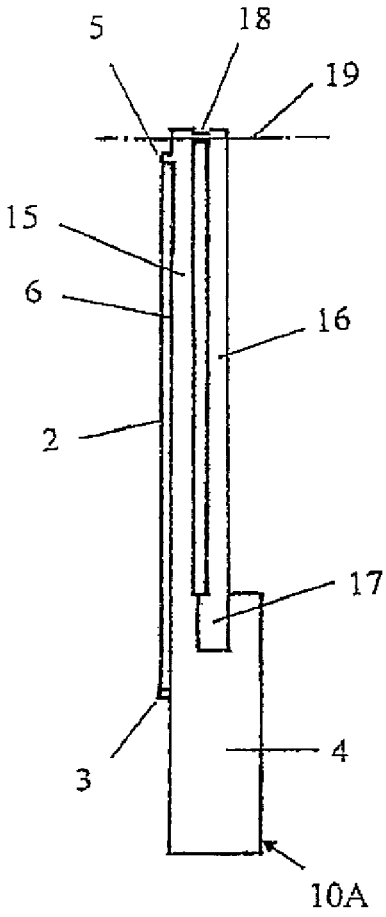
FIGS. 3*a*, 3*b* and 3*c* are schematic side views illustrating a stringed instrument incorporating an example of a neck adjusting arrangement according to the present invention.

FIG. 3*a* is a simplified side elevation (comparable to FIGS. 1 and 2) of a stringed instrument 10A that includes a basic example of the neck adjusting arrangement. Again, the strings 2 are shown disposed between attachment points/bridge 3 (on the body 4) and attachment points 5 at the end of the neck of the instrument. The Figure shows that the neck of the instrument comprises a structural beam or strut 15, which includes a fingerboard 6, and a second structural beam 16 in the form of a cantilever that is rigidly attached to the first beam 15 at one end 17 (preferably the body end of the instrument). An adjustable link 18 is provided as an adjustment mechanism, this being disposed between the two beams 15, 16 at point at or near their ends remote from the instrument body.

Figure 3B:
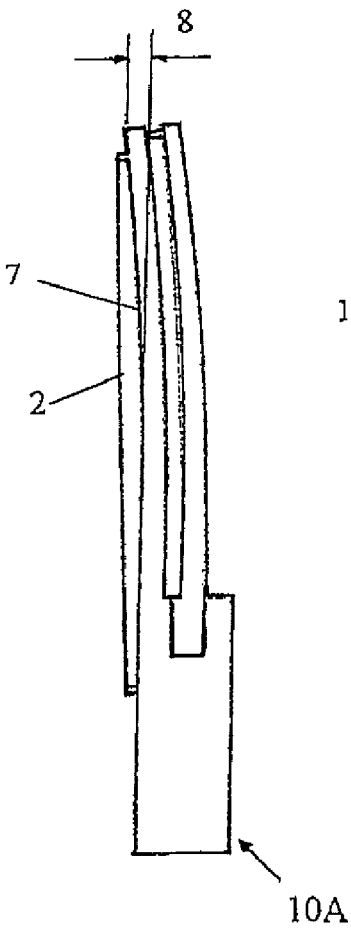
Figure 3C:
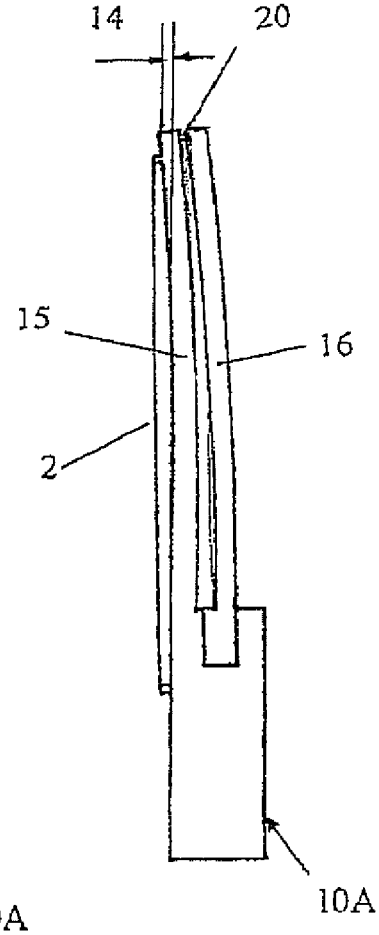

FIG. 3*b* shows schematically the effect produced by the tension of the strings 2, which cause a deflection 8 of the neck and hence a curvature 7 of the fingerboard. FIG. 3*c* shows schematically how the deflection and curvature can be changed by the adjustment mechanism. The Figure shows the effect of changing the relative positions of the two beams; in this case the link is made shorter, (as shown at 20 compared to 18 in FIG. 3*a*). This adjustment results in the deflection of the beam 15 being reduced as shown by arrows 14, which achieves a reduction in the curve of the fingerboard 6. In the example the adjustment mechanism is substantially at right angles to the axis of the neck as shown by axis line 19 and is located at the free end of the neck and cantilever. The second beam 16 may be rigidly attached to beam 15 partially along its length (i.e. extending along the neck of the instrument rather than the attachment ending at the body/neck interface as shown in the example of FIGS. 3) so both beams can be coupled together to resist the bending and compressive forces imparted by the tension in the strings of the instrument. In such an embodiment only the final portion of beam 16 towards the end of the neck of the instrument may be adjustable relative to the beam 15. The adjustment arrangement described above can induce stress levels in, say, beam 16 that are higher than if it were an integral part of beam 15. This allows the beams to be made with a smaller cross sectional area than would otherwise be the case and so the overall weight of the instrument can be reduced. In some embodiments, there could be a spacer or the like indirectly connecting parts of the first 15 and second beams 16 together.

Figure 4:
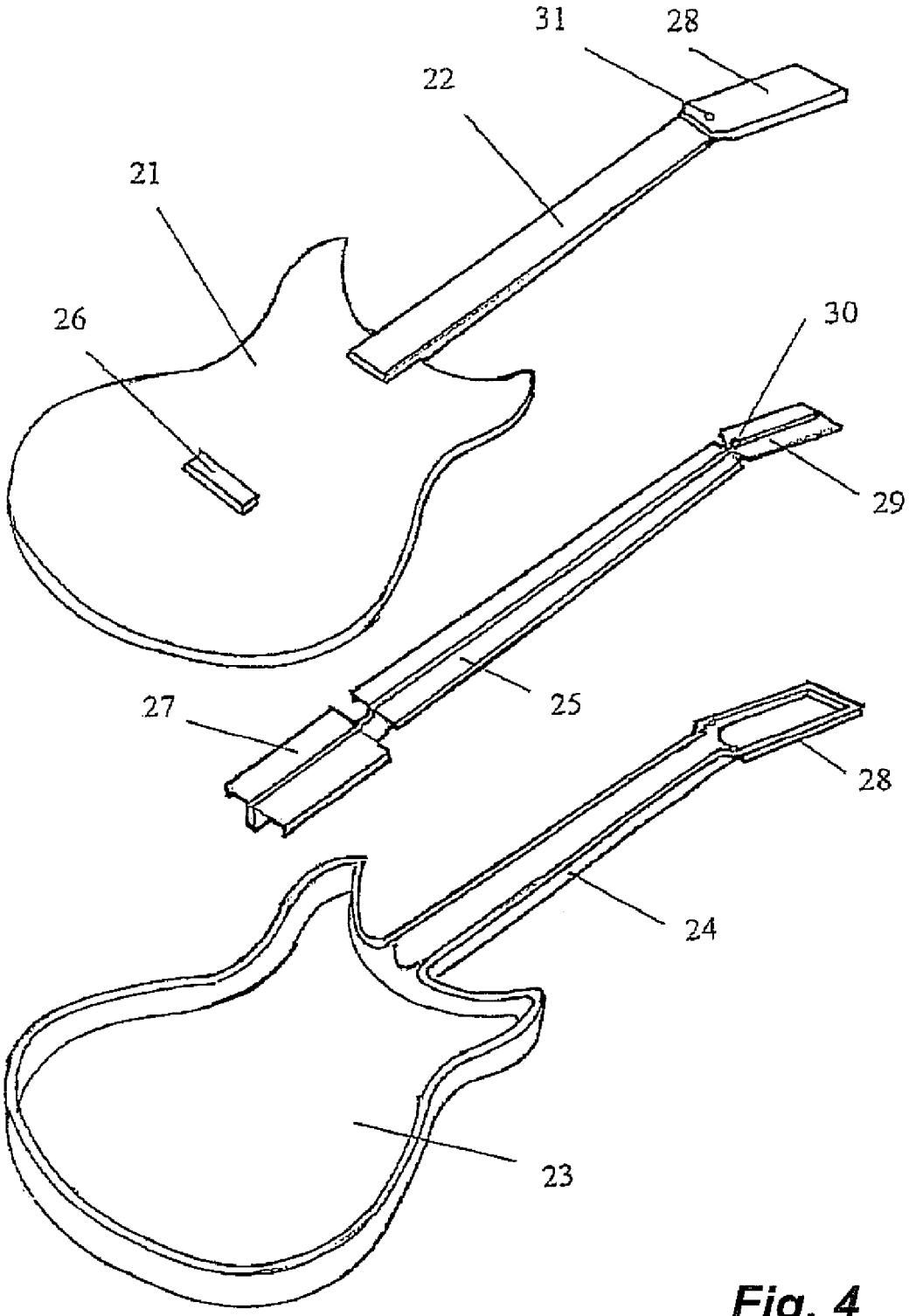
FIG. 4 is an exploded diagram of a stringed instrument similar to that of FIGS. 3*a*-3*c*, including a structural assembly which has a neck adjustment mechanism.

FIG. 4 shows a number of components that can form a guitar similar to the example of FIGS. 3*a*-3*c*. The first component comprises a front shell 21 (including a finger board 22) and a second component comprises a rear body shell 23 (that includes a neck 24). Both shell components 21, 23 can each be formed of one or several components that can be structural and/or non-structural (i.e. ones that effectively contribute little to the structural integrity of the instrument) in nature. A third component includes an assembly 25 that forms a main structural assembly of the instrument and is disposed along the axis of the neck between the two shell components 21, 23. This arrangement allows components of the instrument to be produced from plastic moulded materials, by allowing the loads from the strings to be resisted by materials that do not suffer from creep (where they distort over time at stress levels below their yield point, which a typical plastic moulded material could do) and can also allow easy adjustment of the neck or fingerboard curvature. The example is a typical electric guitar, although it will be understood that the neck adjusting arrangement can also be used in acoustic guitars and other stringed instruments.

The structural assembly 25 preferably extends from at least the anchorage point/bridge 26 of the strings at the body end of the instrument up the headstock (or peg head) 28 that incorporates the string tuners (not shown in this Figure) that allow the tension in the strings to be varied. The assembly 25 is attached to at least one of the shell components (preferably the front shell 21 at the string anchorage position 26 at portion 27; along the rear (inner) surface of the finger board 22 at portion 25, and to the inside of the headstock/peg head 28 at portion 29). Typically, the structural assembly 25 is produced from metal components, but it will be understood that it may be produced from other suitable material, such as carbon fibre reinforced epoxy resin.

The assembly 25 further includes a mechanism 30 that acts as an adjustable link to allow adjustment of the curvature of the neck 24, including the fingerboard 22, of the instrument (as demonstrated in FIG. 3*c*). Typically, the adjustment mechanism 30 is accessed through a hole 31 in front shell 21, at a location generally between the end of the fingerboard 22 and the headstock 28.

Figure 5:
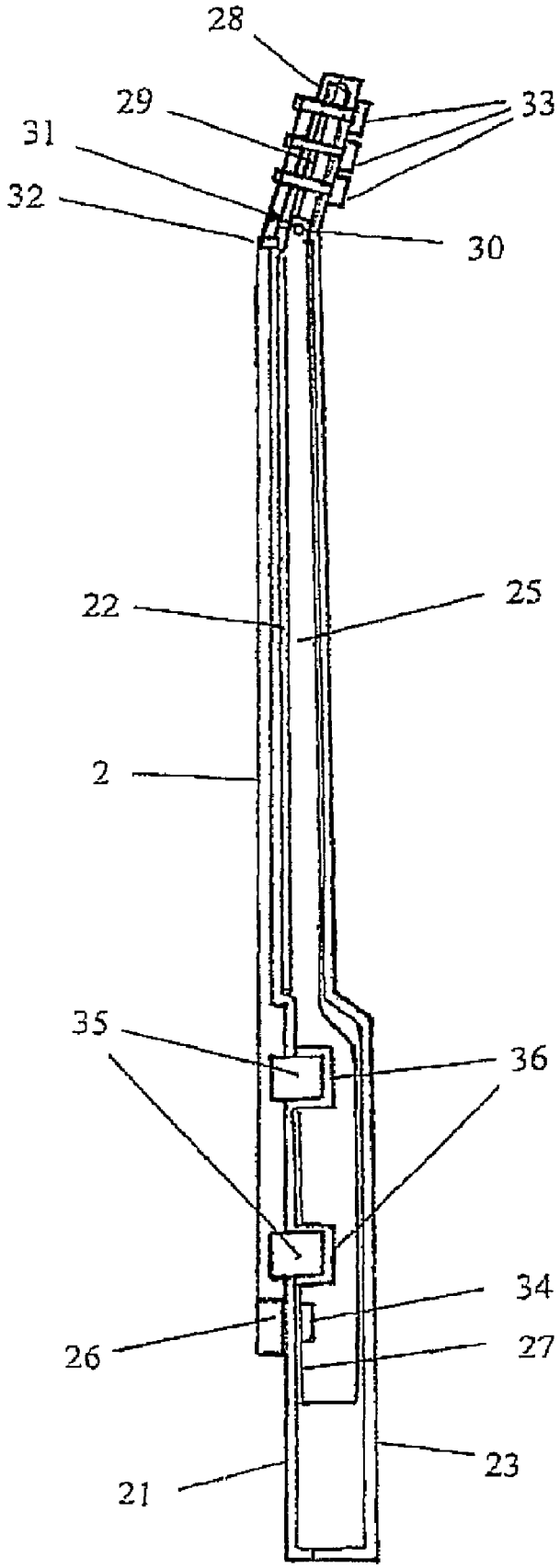
FIG. 5 is a cross-sectional side view of the stringed instrument of FIG. 4 in assembled form.

A more detailed view of the construction of the instrument in assembled form is shown in the longitudinal cross section of FIG. 5. The structural assembly 25 effectively forms a beam that typically extends from the bridge 26, where the strings 2 are anchored to (or through) the body of the instrument, to the end of the neck where the string tuners 33 anchor the strings to the headstock 28. The assembly may include cut away portions, e.g. at 36 to clear electromagnetic pick ups 35, if fitted. Outer portions of the assembly may be extended outwards laterally and/or have deeper return flanges at their extremities to compensate for any loss of strength or rigidity created by such cutouts. The adjustment mechanism 30 is typically located on the headstock side of the neck beyond a "nut" 32 that guides the strings between the fingerboard area and the string tuners 33. As mentioned above, the structural assembly 25 can be attached to the inner surface of the front shell 21 of instrument at least the areas of the string anchorage attachment means 26, 34, and the rear side of the fingerboard 22. The fingerboard (or at least its playing surface) may be made from wood as an alternative to a moulded part. The string tuners 33 can also be located through and supported by the structural assembly 25 in area 29 of the headstock 28.

A more detailed arrangement for the structural assembly 25 is shown in FIG. 6, which, again, is an exploded view. The assembly 25 comprises two outer lateral beams 37, 38, which are mainly of 'L' or asymmetric 'U' cross section, and can be mirror images of each other, but in other embodiments the formation and/or appearance of each beam can differ, e.g. in some cases the two beams can be formed of a single casting. These outer beams are disposed either side of a centre beam 39 that is held in a substantially rigid manner to the outer beams at one end (typically the body end of the instrument) by means of nuts 45 and bolts 44, but it will be understood that any other suitable fixing means could be used, e.g. or rivets, welds or adhesive bonding. The centre beam 39 can therefore form a cantilever member, one end of which is connected (indirectly) to the body of the guitar. In other embodiments the cantilever member can be connected directly to the body of the guitar and/or (indirectly or directly) to the neck portion. It will be understood that the extreme end of the cantilever member does not necessarily have to be connected to the body/neck; having a portion adjacent to that end fixed to the body/neck can effectively provide the same functionality.

In other embodiments, the beam cross sections may be varied. For instance, the centre beam may be of 'T' section and can be comprised of more than one component fixed together, and the outer beams can be of any section that fits within the remaining cross sectional area of the neck. The outer 37, 38 and centre beams 39 may taper along their length as the bending stresses reduce towards the headstock end of the neck. The two outer beams 37, 38 are joined together by a saddle piece 42 that can be a separate piece as shown in the Figure, or may be formed as tabs on the outer beams themselves. A means for aligning the axis of the elongate member of the adjustment device with other parts of the device may be provided, e.g. slotted holes for assembly screws that hold the various items together.

An adjustment mechanism 30 is provided to alter the relative positions of the outer and centre beams. The adjustment mechanism can be a threaded arrangement where a screw 41 passing through an aperture in the saddle piece 42 engages a threaded boss 40 attached to the centre beam 39 or into a threaded hole formed directly in the centre beam. (Alternatively, a stud may be permanently engaged with the threaded boss 40 (or again directly into a threaded hole in the centre beam) and a nut can be used to effect the adjustment). The adjustment mechanism 30 is thus located adjacent the free end of the centre beam 39, although its position could be varied anywhere between the end of the beam 39 remote from the body and a point about 50% along its length. However, it will be understood that other arrangements can be implemented, e.g. removable spacers between the beams or a ratchet-like mechanism. The saddle piece 42 can be either just local to the adjustment mechanism 30, or it may extend further along the neck to provide additional strength in an "unsupported" part of the assembly between the portions 29 and 38.

By turning the screw 41, the position of the outer beams 37, 38 relative to the centre beam 39 can be changed, the two outer beams being moved simultaneously as the position of the saddle (which houses the adjustment device) is adjusted relative to the cantilever member. This in turn adjusts the curvature of the neck of the instrument (and hence the curvature of the fingerboard). Tightening the screw will reduce the curvature of the neck under the load imposed by the tension in the strings and loosening the screw increases the curvature. An initial "start" position (where both beams are in an unstressed condition before the strings are tensioned) can be varied so that the adjustment provided can result in the neck, under the influence of the string tension, to vary from being substantially straight (when the screw is fully tightened) to a significant bow (when the screw is fully loosened). Whilst the adjustment mechanism is configured as shown, the centre beam may also bear upon the outer members along discrete areas of their length, which could allow the resulting curvature of the fingerboard to be modified over its length. Compared to a conventional truss rod adjustment design the arrangement described herein allows a much finer degree of adjustment. Normally, a truss rod requires a significant adjustment torque and operates over typically one turn of the threaded adjustment member, whereas the present design requires a very low torque and operates over a typical adjustment range of 6 or 7 turns of the threaded adjustment member.

Figure 6:
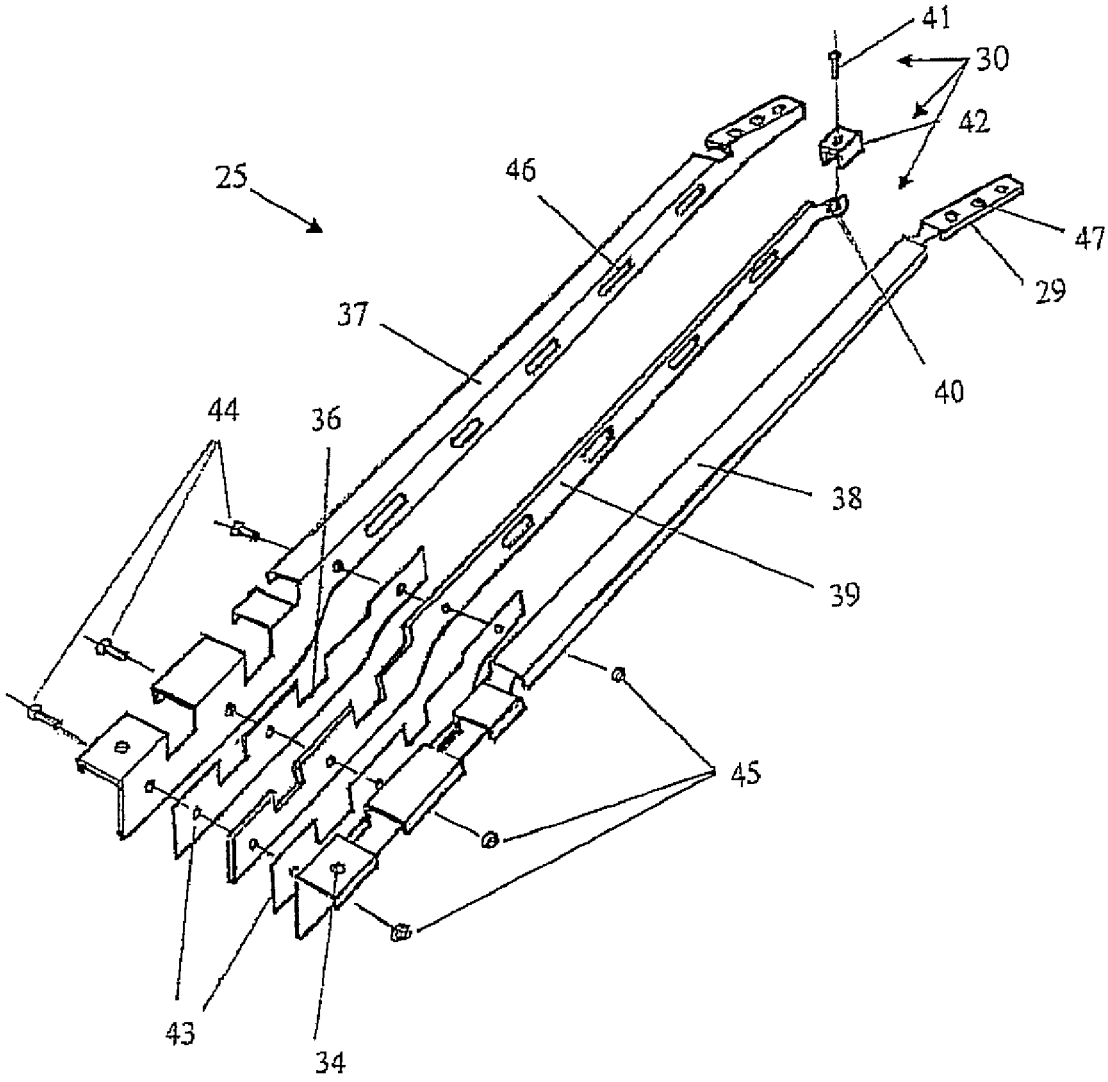
FIG. 6 is an exploded diagram of the structural assembly of FIGS. 4 and 5.

FIG. 6 also shows the parts of a "sandwich" construction of the structural assembly that contains reinforcing and spacing members 43 located between the outer beams 37, 38 and the centre beam 39. These spacing members provide a more rigid assembly at the body of the end of the instrument (where little curvature of the neck or fingerboard is required), but in addition provide a clearance between the outer beams 37, 38 and the centre beam 39. This prevents rattles and friction between the outer and centre beams. The surfaces that can potentially contact may be given a low friction surface treatment and/or "damping" material (a felt material, for instance) can be positioned in the clearance area (in either a continuous strip or in discrete areas). The reduction of friction makes the adjustment means smoother in operation and more accurate/stable. Some masking material may be incorporated in this area to prevent adhesive that is used for bonding the outer members 37 and 38 to the rear/inside surface of the fingerboard 22 from contacting the centre beam 38 so as to avoid problems that would prevent adjustment.

The beams shown as 37, 38 can be metal parts that are either blanked to shape or cut by means of a laser or other method, and then formed or bent to the required shape. Holes or slots (shown in FIG. 6 as 46) can be incorporated in either or both of the beams to lighten the overall construction and also to change the beams' stiffness, thereby giving good weight arrangement and performance. Similar holes or slots can also be incorporated into the centre beam 39 and/or the spacers 43. Clearance holes or slots may also be incorporated in beams 37 and 38 at and between the location positions of the instruments fret wires.

Figure 7:
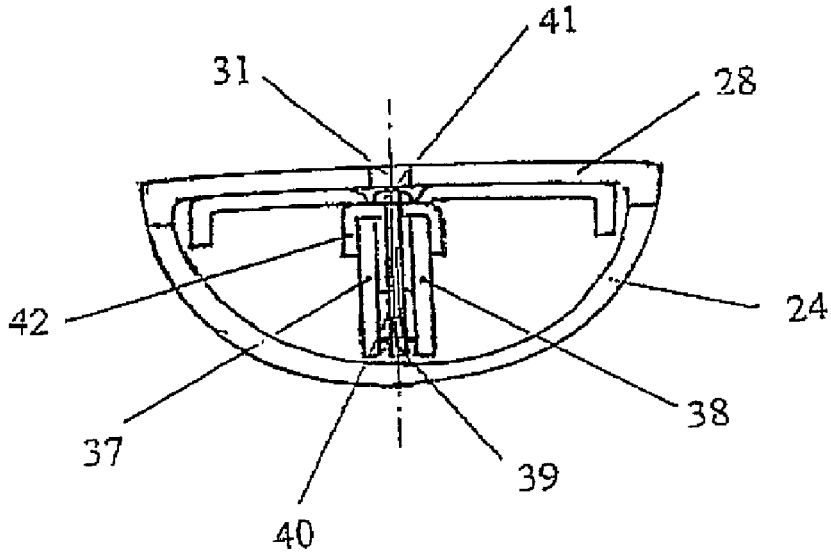
FIGS. 7 and 8 are sectional views through the instrument and assembly in assembled form.

FIG. 7 shows a cross section through the neck at the centre line of the screw 41, which is in the area between the fingerboard 22 and the head stock 28 as shown in FIG. 4. The Figure shows part of the centre beam 39, the outer beams 37, 38 and the screw 41 passing through the saddle piece 42 and engaging in the threaded boss 40 that is connected to the end of the centre beam 39. (As noted before the female thread could be formed directly in the beam 39 rather than in a separate boss 40). Access to the adjustment screw (e.g. for a tool) is by means of a hole 31 in the headstock 28 area of the outer shell. The structural beams 37, 38 and 39 can be arranged to give a significant second moment of area to give a stiff neck structure. Outer beams 37, 38 can also be seen to be attached to the rear of the outer shell component 28 and may have a clearance to the rear shell of the instrument 24, or may also be attached to this part. The outer beams 37, 38 are attached to a surface of the neck of the instrument by means of glue, staking, bonding or any other suitable attachment method. The fingerboard 22 may either be a plastic moulding (with or without fibre reinforcement), or a conventional wooden part.

Figure 8:
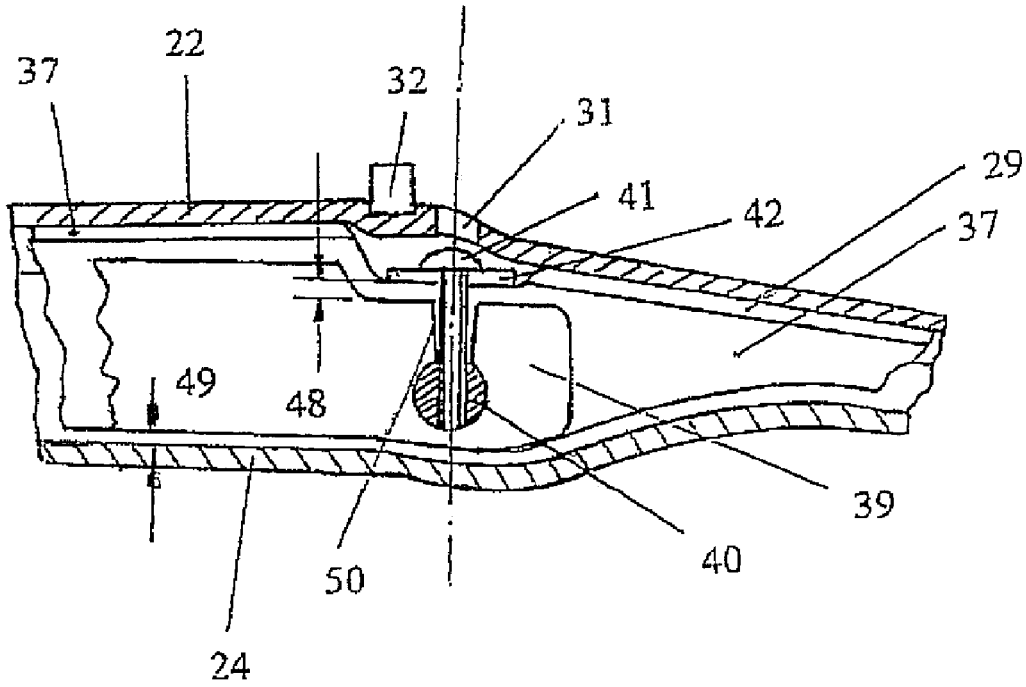

FIG. 8 shows a further sectional view as a partial centre line section through the neck at the location of the adjustment mechanism. This shows a slot 50 in the centre beam 39 to allow clearance for the screw 41. Typically, the centre beam 39 extends only shortly beyond this area (to keep weight to a minimum), whereas the outer beam 37 (and 38, not shown) may extend into the headstock. The Figure also shows gap 48 between the centre beam 39 and the saddle piece 42 that will be reduced by tightening the screw 41 into the boss 40 and this action reduces the curvature of the neck and fingerboard 22. Clearance may also be provided at 49 between the centre beam 39 and the rear shell 24. This gap will increase as the screw 41 is tightened. Typically, the clearance 49 may also provided between the outer beam 37 (and 38) and the rear shell 24 and this will remain substantially constant. The access aperture 31 is located adjacent to the nut or string guide 32, on the headstock side of the neck rather than the fingerboard surface.

Whilst a single adjusting screw is shown in the example, other embodiments cover the use of multiple screws, e.g. a pair of screws, each disposed either side of the central axis of the neck. Such an arrangement, as well as allowing adjustment of the curvature of the neck and fingerboard, can also allow any twisting of the neck (for instance, if string gauges are used that create asymmetric loading across the centre axis of the neck) to be adjusted. Further, whilst the screw arrangement is shown to be accessed via the front surface of the neck of the instrument, it could be accessed from other orientations, typically ones that are at substantially 90° to the axis of the neck.

Figure 9:
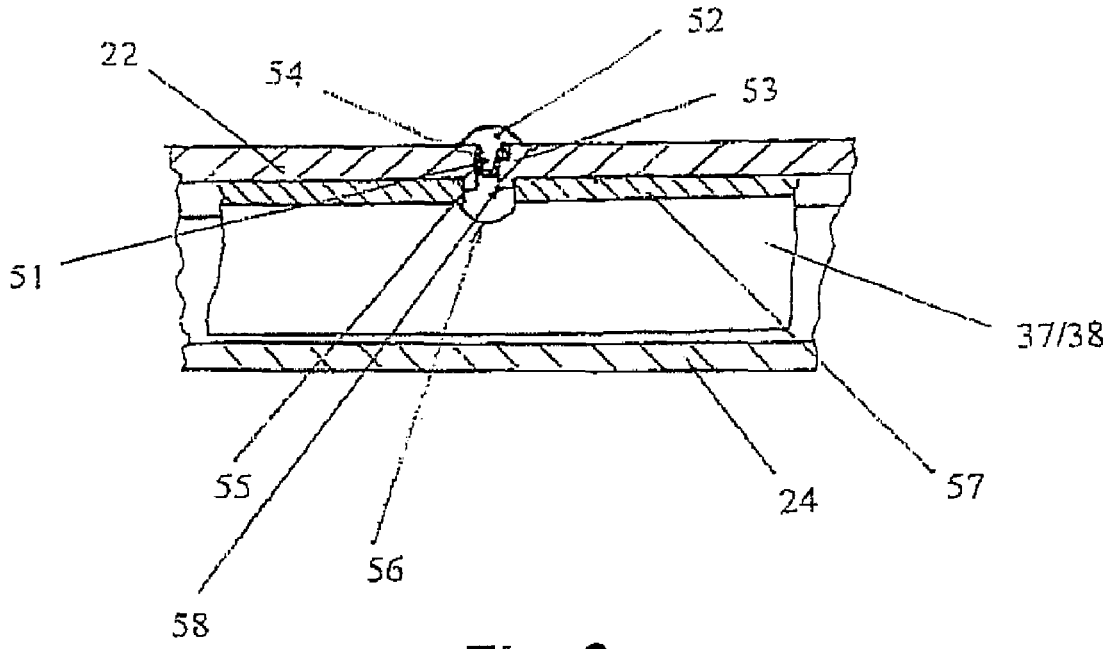
FIG. 9 is a sectional view through part of the neck of the instrument.

FIG. 9 is a partial longitudinal section through the neck through the transverse flange of an outer beam 37, 38 and shows a fingerboard 22 which has slots 51 to allow the fret wire 52 to extend through the fingerboard and be held in place with an adhesive 53 (shown in solid black) applied through the rear surface of the finger board to the tangs 54 of the fret wires 52. This results in a reduced likelihood of adhesive contaminating the fingerboard. Conventionally, the frets are glued in place if a fingerboard is made from a plastic material (and if a conventional wooden fingerboard is used the fret wires can be retained to it in the usual manner for such parts, typically an interference fit) into slots that do not extend right through the fingerboard cross section.

Raised areas 58 can be incorporated to help prevent adhesive from the bonding between the flanges 57 of outer beams 37, 38 and the fingerboard area 22 from entering the fret slots 51. The adhesive for the fret is applied through slots 55, 56 in the beams 37, 38. The parts of the structural member shown in FIG. 6 can be made into a sub-assembly including the adjustment mechanism prior to attachment to the front shell of the instrument. If a moulded construction is used for the front shell 21 of the instrument and this incorporates a moulded fingerboard 22, then the structural assembly 25 can be fixed into place whilst the moulding is still in the mould to ensure accurate alignment of all the parts. The rear shell of the instrument can then be attached to front shell after the fret wire is added as shown in FIG. 9.

Figure 10:
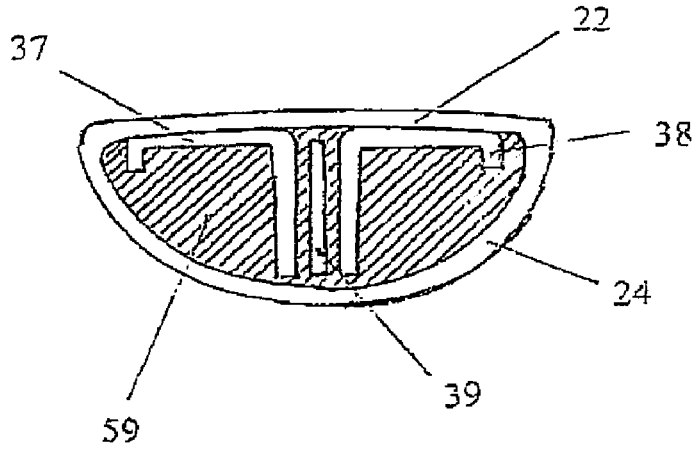
FIG. 10 is a cross-sectional view through a neck of another example instrument.

All or some void areas in the neck or body of the instrument may be filled with foam, or similar material, to provide extra strength if required. FIG. 10 is a cross sectional view through a neck of such an example of an instrument, showing the beams 37, 38 and 39 and the remaining volume of the neck inside the shell components 22, 24 being filled with a rigid or semi-rigid foam material 59 that still permits the adjustment of the neck and fingerboard curvature.

Figure 11:
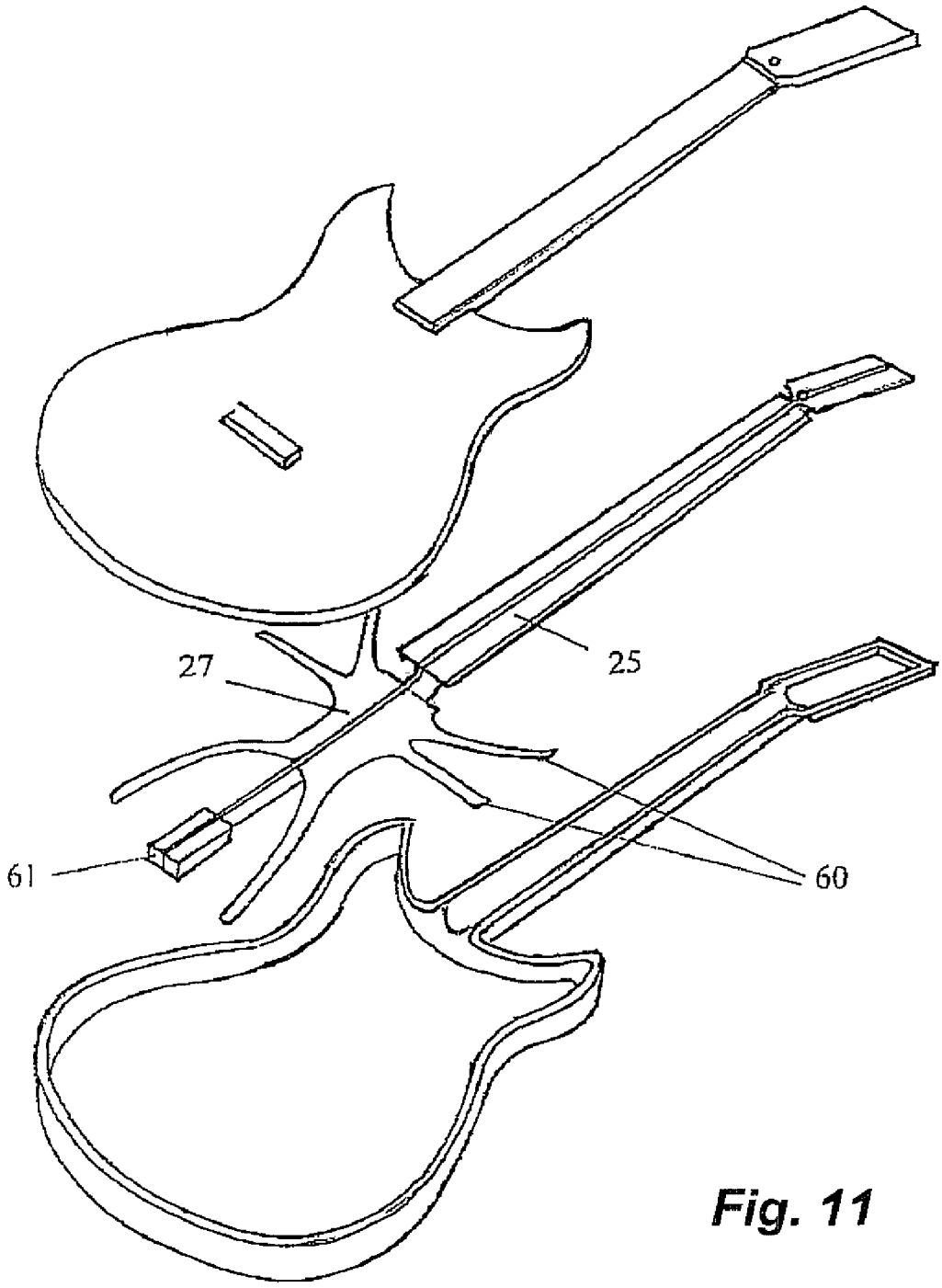
FIG. 11 is an exploded view of yet another example instrument.

The structural member 25, whilst giving strength and stiffness to the neck of the instrument to resist the tension imposed by the strings, may also be extended outwards to provide support to other areas of the instrument, in particular to the body if the latter is made from plastic shells. FIG. 11 (which is an exploded view similar to FIG. 4) shows the structural assembly 25 having extensions 60 that extend from portions, e.g. 27, of the body portion of assembly 25 and these can be linked to other parts of the instrument to provide support to the locations of the attachment means for a strap—or just to give enhanced rigidity to the moulded shells. (An extension may also run from the body of the instrument to the headstock in a manner approximately parallel to the neck but spaced from it to provide additional structural support for the neck). They can also assist in removing the moulded shell from the mould tool cavity after the structural assembly 25 has been attached to the front shell whilst the latter is still within the tool by forming a rigid member that can be pulled from the tool whilst attached to the moulding. A counter balance mass 61 can also be incorporated which can alter the longitudinal position of the centre of gravity of the instrument.

Figure 12:
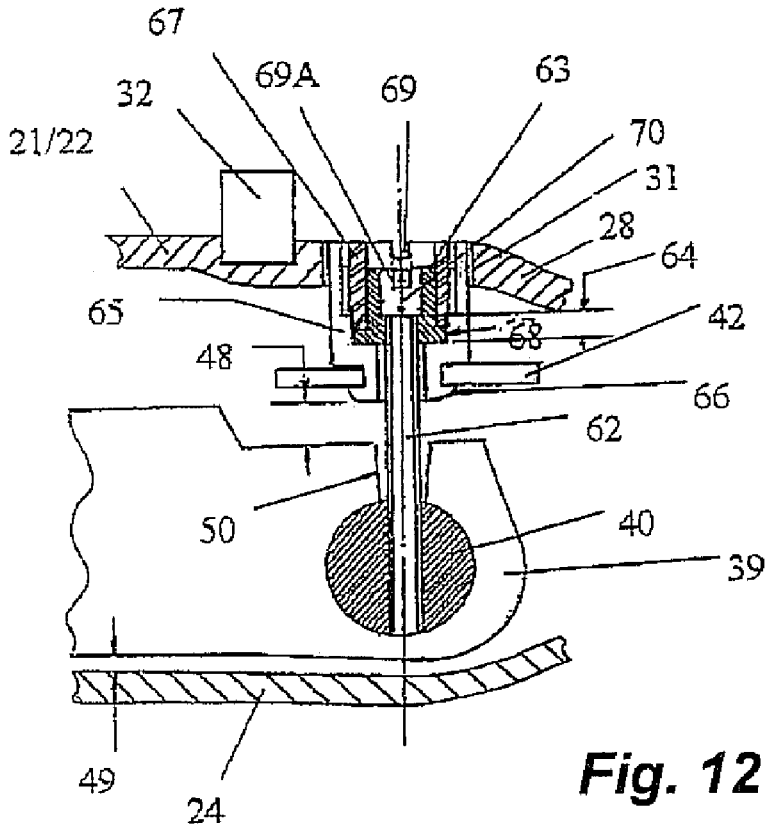
FIG. 12 is a sectional view, similar to that of FIG. 8, of an alternative version of the instrument that includes an arrangement for locking the adjustment mechanism.

The alternative embodiment shown in FIG. 12 (which is a sectional view similar to that of FIG. 8) includes an arrangement for locking the adjustment mechanism, which can limit its movement due to vibration, etc. This also has the advantage that if the neck is only lightly loaded/stressed then the arrangement is less likely to rattle.

The centre beam 39 has a boss 40 attached to it and incorporates a slot 50. Alternatively a stud 62 may be screwed directly into a threaded hole in the centre beam 39. A stud 62 is engaged with the boss 40 and retained within it, preferably by means of a thread locking adhesive. (Alternatively, it could be torqued into a blind hole in the boss). The opposite end of the stud 62 engages with a threaded member 63. The threaded member 63 has a thread that matches a thread on the stud 62, the thread on the member 63 preferably extending over a length 64. This length 64 is chosen in relation to the materials of parts 62 and 63 such that the threads will shear on part 63 before a tensile force can be generated in the stud 62 sufficient to cause it to break.

The threaded part 63 is located within a housing 65. The housing 65 is preferably staked or retained by means of a threaded area and a nut (or otherwise retained) in the saddle piece 42. The retention is such that no significant relative axial or rotational movement can occur between the two parts. A further threaded part 67 is also located within the housing 65. Part 67 is arranged so that it can be screwed into the housing 65 to clamp down on an upper flange 68 of the threaded part 63 (or directly onto the threaded part 63), thereby preventing the threaded part 63 from significant axial or rotational movement. Parts 63, 67 have features (such as slots 69A, 69) that can be rotated using a screwdriver or the like. The housing 65 may protrude through the hole 31 in the front moulding 21, 22, 28 of the guitar. In practice, this protrusion may also form the main location datum when the neck structure assembly is fixed to the front moulding 21, 22, 28.

To effect adjustment, the threaded part 67 is slightly unscrewed to release the clamp effect on part 63. Part 63 is then adjusted on the stud 62 to obtain the required deflection of beam 39 and hence the required fingerboard relief. Part 67 is then retightened to "lock" the adjustment position. As well as locking the adjustment, there is also no permitted relative movement between beam 39 and the saddle piece 42.

The distance 70 between the top of part 63 and the end of the stud 62 may be chosen to be similar to the adjustment gap 48. Thus, as part 63 is tightened onto the stud 62 the depth of the slot 69 that can be engaged by a screwdriver in part 63 gradually reduces to zero. It will therefore not be possible to "over adjust" the mechanism with potentially damaging results. (Unless, for instance, a specially modified screwdriver with a rebated end is used).

In a similar manner the gap 49 is maybe chosen to be no less than the thread length 64 so that if "over adjustment" is effected in the opposite direction the centre beam 39 cannot contact or damage the rear moulding 24. The stud 62 and housing 65 will normally be made from stronger materials than the parts 63 and 67 (for instance, 62 and 65 may be made from steel and 63 and 67 from brass). The advantage of this is that any abuse or damage to the mechanism causes the threads in parts 63 and 67 to shear or strip before those of parts 62 and 65. Such damaged parts can then easily be extracted and replaced in service.

Figure 13:
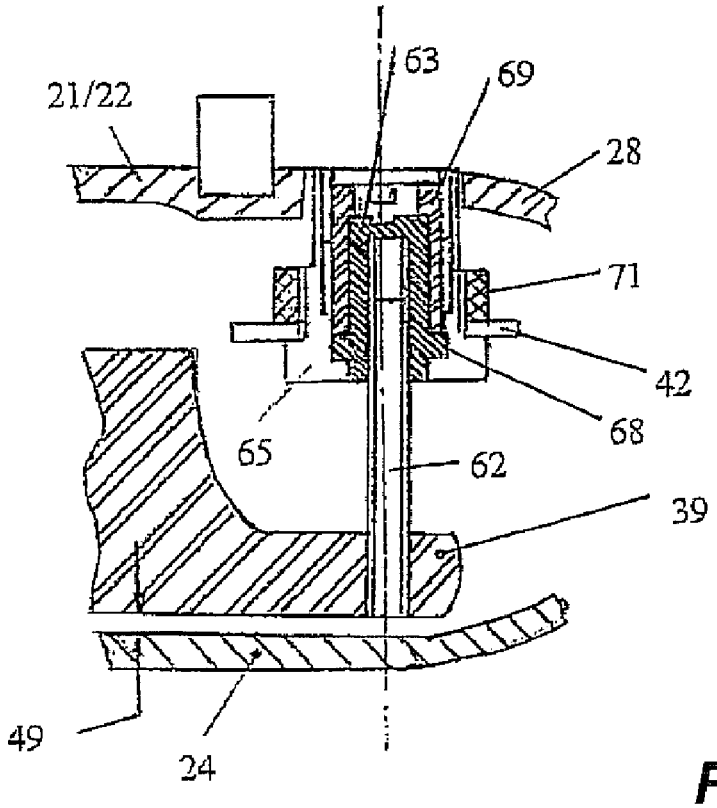

FIG. 13 shows a further alternative design arrangement where the adjustment thread maybe configured to be a blind hole in part 63 so that the threaded portion of the stud is not visible from the outside of the instrument thereby reducing the chances of any contamination or corrosion occurring that might effect the ease of adjustment. This Figure also shows the housing 65 being held to the saddle 42 by means of a nut 71 rather than the former being held by a staking operation.

Figure 14:
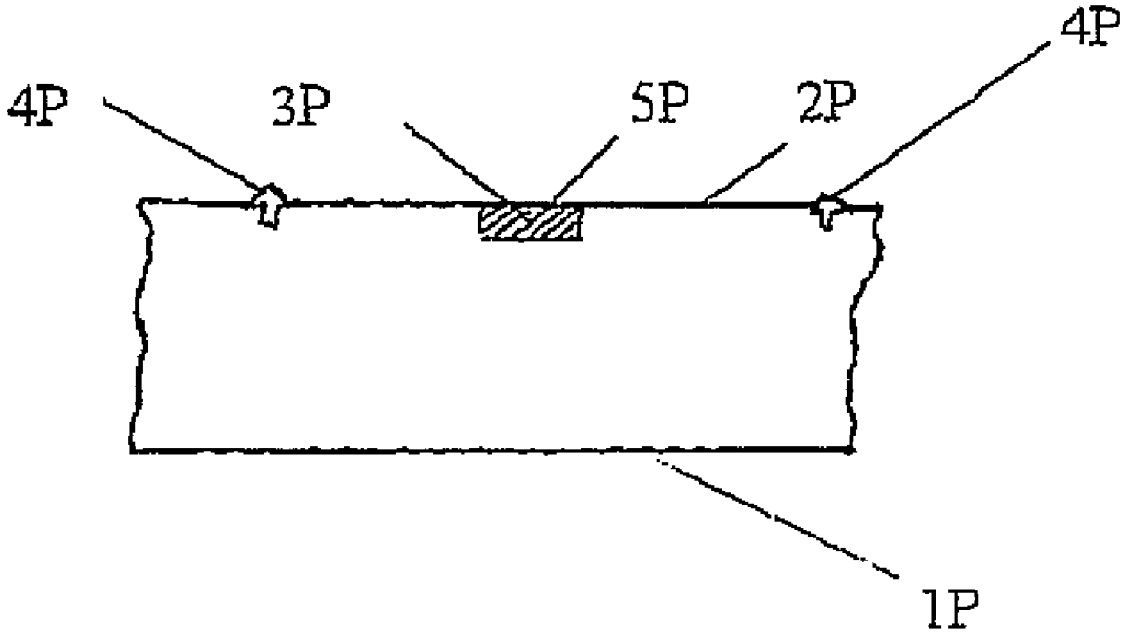
FIG. 14 is a partial longitudinal cross-section through a neck of an example instrument, showing a set of integrally-moulded position markers.

FIG. 14 shows a partial longitudinal centre-line cross section through a neck portion of an example instrument. The neck portion includes a plastic fingerboard having a surface 2P with a position marker 3P inset into the surface such that its outer surface 5P is level with the surface 2P of the fingerboard. The position marker is located in an area between the frets 4P. The position markers are formed of a plastic having a contrasting colour to the main surface 2P of the fingerboard. At least the fingerboard is made from a plastic moulding (with or without any reinforcement material). At manufacture, the position marker may be moulded first and then over moulded with the fingerboard or the fingerboard can be moulded first and then the position marker can be moulded into the fingerboard.

Where the fingerboard is made by a laminating process such as glass fibre (or other fibre types) reinforcement dispersed within a polyester, (or epoxy), resin, the playing surface of the fingerboard can be made from a hard wearing resin normally termed a gel coat that is applied to the mould and allowed to partially cure prior to main moulding being produced. (One or more coats of the gel coat resin are applied to the mould surface). In this process the fingerboard surface and position markers are in contrasting coloured gel coat materials and the main moulding that is then laminated or injected behind them is then applied.

As well as providing contrasting position markers in a fingerboard, the techniques outlined above can also be applied to other areas of an instrument, if those surfaces are made from plastic materials and are produced using a mould. For instance, the fingerboard area may be in a contrasting colour to other parts of the instrument such as the body, and an integral pick guard surface maybe produced in a contrasting colour to the body. The body can be of a contrasting colour to the fingerboard 2P (with contrasting coloured position markers 3P), and a pick guard area and the headstock can also be in contrasting colours. In addition to coloured plastic polymers, substantially the same effect can also be achieved by using paint applied to the mould surface prior to the moulding process. Whilst FIG. 14 shows discrete position markers (typically round dots) on the fingerboard surface, the process can be used for any shape or form that allows the player to determine a position on the fingerboard, and it can also be used on the side of the neck or fingerboard for a similar purpose.

The various construction techniques described above can result in an instrument that employs metal parts for its main structural elements and as such is relatively unaffected by changes in temperature and humidity compared to an instrument constructed from wood (where the wood also has a structural role). Metal parts can also be much more tightly controlled in terms of their strength and stiffness compared to a wooden part, as the latter, being an organic material, can have very significant variation from tree to tree. The use of metal parts helps ensure that the instruments are very consistent from one example to another. It will be understood that versions of the neck adjusting arrangement can either be installed in an instrument during its construction, or could be retro-fitted to existing neck portions/instruments.

Whilst the main examples described above have the adjusting mechanism and structural parts housed within a complete instrument it is also possible that such an adjusting arrangement can be provided within (or in/on)_a neck portion that can then be fitted to a conventional guitar body component. The body component will typically be made from wood and the neck portion may also be formed of wood, or some other material, including plastic. This type of neck design can either be fitted during the original manufacture of the guitar, or retrofitted at a later time.

I claim:

1. A stringed instrument neck structure adjusting arrangement including:

a bending member, one end of which is configured to be connected, in use, to a body and/or neck structure of the stringed instrument, wherein the instrument is formed of at least two members forming a shell in which the neck structure adjusting arrangement is fitted within said shell; the bending member configured to be moveable relative to a free end of the neck structure of the stringed instrument, and an adjustment device located at or adjacent a free end of the bending member remote from the body, the adjustment device configured to adjust a position of the bending member relative to the neck structure in a plane substantially perpendicular to a main axis of the neck structure, thereby providing a force in a direction substantially perpendicular to the bending member and adjusting curvature of the neck structure, wherein a gap separates the bending member from the neck structure.

2. An arrangement according to claim 1, further including an elongate member configured to extend at least partially along a length of the neck structure, one end of the elongate member being connected to the body or neck structure, another end of the elongate member being adjustably connected to or adjacent the free end of the bending member.

3. An arrangement according to claim 2, wherein the bending member is elongate in shape and extends substantially parallel to at least part of the elongate member.

4. An arrangement according to claim 3, wherein one end of the bending member is configured to be fixed to a portion of the elongate member that is located within the body of the stringed instrument, or to a portion of the neck structure at or adjacent the body of the stringed instrument.

5. An arrangement according to claim 1, wherein the bending member is rigidly connected to the body and/or the neck structure of the stringed instrument and the rigid connection resists compressive and bending loads imparted by tension of strings of the instrument.

6. An arrangement according to claim 2, wherein the elongate and bending members are connected to the neck and/or the body of the stringed instrument by means of a separate assembly that is fixed within, or to, the neck and/or the body.

7. An arrangement according to claim 6, wherein the assembly includes extending portions configured to be linked to portions of the instrument.

8. An arrangement according to claim 1, wherein a portion of the bending member at or adjacent its free end is not directly connected to an elongate surface of the neck structure of the stringed instrument.

9. An arrangement according to claim 2, wherein the elongate member comprises first and second elongate bars, each said elongate bar being located either side of the bending member.

10. An arrangement according to claim 2, wherein the elongate member and/or the bending member are at least partially formed of metal.

11. An arrangement according to claim 9, where a low-friction surface treatment or material is present on/between at least parts of the bars and corresponding sides of the bending member.

12. An arrangement according to claim 9, wherein the first and second elongate bars are at least partially of generally L or U-shaped cross section.

13. An arrangement according to claim 12, wherein a stem portion of each of the first and second L or U-shaped elongate bars is, in use, located parallel to a respective side surface of the bending member and a portion of each said L or U-shaped member transverse to its stem portion is configured to be (directly or indirectly) connected to inside a surface of the instrument having a fingerboard portion of the neck structure.

14. An arrangement according to claim 2, wherein the adjustment device includes an elongate adjustment member extending generally perpendicularly with respect to the bending member, the bending member being movable along, or with, the elongate adjustment member, and the adjustment device further includes a formation for arresting such movement of the elongate adjustment member and the bending member.

15. An arrangement according to claim 14, wherein the adjusting device includes a threaded member, in use, rotation of the threaded member results in movement of the elongate member relative to the bending member.

16. An arrangement according to claim 9, wherein the adjusting device further includes a saddle piece in contact with the adjustment device, the saddle facilitating simultaneous movement of the first and second bars relatively to the bending member.

17. An arrangement according to claim 2, including a further device adapted to prevent or damp any rattles between the bending and elongate members and also to align the bending member between the elongate members, the further device being disposed between the adjacent surfaces of the bending and elongate members.

18. An arrangement according to claim 1, further including an arrangement configured to lock the adjustment device.

19. An arrangement according to claim 18, wherein the adjustment device locking arrangement comprises a clamping member whose position relative to an elongate surface of the neck structure is fixable, in use, the clamping member contacting a portion of the adjusting device, thereby limiting/preventing its movement.

20. A neck structure for a stringed instrument including an adjusting arrangement according to claim 1.

21. A stringed instrument including a neck structure adjusting arrangement according to claim 1.

22. A stringed instrument according to claim 21, further including a counter-balance mass located within a body portion of the instrument.

23. A stringed instrument according to claim 21, wherein the shell includes a formation to allow access to the adjusting device, the formation being located on a portion of the neck structure remote from the body, or on a surface of a head portion over which strings of the instrument extend.

24. A stringed instrument according to claim 21, including a plastic fingerboard having integrally-moulded position markers, the fingerboard also being formed of a plastic material.

25. A stringed instrument neck structure adjusting arrangement including:

a bending member, one end of which is configured to be connected, in use, to a body and/or neck structure of the stringed instrument, wherein the instrument is formed of at least two members forming a shell in which the neck structure adjusting arrangement is fitted within said shell; the bending member configured to be moveable relative to a free end of the neck structure of the stringed instrument, and an adjustment device located at or adjacent a free end of the bending member remote from the body, the adjustment device configured to adjust a free end position of the bending member relative to the neck structure in a plane substantially perpendicular to a main axis of the neck structure, thereby providing a force in a direction substantially perpendicular to the bending member and adjusting curvature of the neck structure, wherein a gap separates the bending member from the neck structure.

* * * * *